US008257140B2

(12) United States Patent
Kenny

(10) Patent No.: US 8,257,140 B2
(45) Date of Patent: Sep. 4, 2012

(54) CONCEALED AND DISCREET SECURITY POCKET

(76) Inventor: Judith Ann Kenny, Merrick, NY (US)

( * ) Notice: Subject to any disclaimer, the term of this patent is extended or adjusted under 35 U.S.C. 154(b) by 239 days.

(21) Appl. No.: 12/560,638

(22) Filed: Sep. 16, 2009

(65) Prior Publication Data

US 2011/0065359 A1 Mar. 17, 2011

(51) Int. Cl.
*A41C 3/00* (2006.01)

(52) U.S. Cl. ..... 450/89; 450/36; 2/247

(58) Field of Classification Search ..... 2/267, 268, 2/247–251, 238, 227, 115, 105, 106, 113, 2/114, 96, 108, 95, 90, 83, 85, 94; 450/36–39, 450/54–57, 89; 623/7, 8
See application file for complete search history.

(56) References Cited

U.S. PATENT DOCUMENTS

| | | | | |
|---|---|---|---|---|
| 1,071,808 | A * | 9/1913 | Scott | 450/56 |
| 2,067,379 | A | 1/1937 | Cristofanetti | |
| 2,397,247 | A | 3/1946 | Davidson | |
| 2,429,308 | A * | 10/1947 | Cooper | 623/7 |
| 2,492,862 | A | 12/1949 | Harvey | |
| 2,864,374 | A | 12/1958 | Verreault | |
| 2,866,463 | A | 12/1958 | Verreault | |
| 2,881,764 | A | 4/1959 | Verreault | |
| 2,920,628 | A | 1/1960 | York | |
| 3,398,749 | A | 8/1968 | Barg | |
| 3,518,998 | A | 7/1970 | Barg | |
| 3,619,819 | A * | 11/1971 | Mann | 623/7 |
| D241,189 | S | 8/1976 | Clark | |
| 4,185,332 | A * | 1/1980 | Jahnig | 623/7 |
| 4,203,449 | A | 5/1980 | Winzelberg | |
| 4,338,946 | A * | 7/1982 | Donnelly | 450/57 |
| 4,389,801 | A | 6/1983 | Sharrock et al. | |
| 5,395,280 | A | 3/1995 | Greenberg | |
| 5,496,205 | A | 3/1996 | Lee | |
| 5,551,092 | A | 9/1996 | Weber-Unger | |
| 5,573,441 | A | 11/1996 | Smith | |
| 5,782,671 | A | 7/1998 | Suen et al. | |
| 5,950,239 | A | 9/1999 | Lopez | |
| 5,989,101 | A | 11/1999 | Jenn-Shyang et al. | |
| 6,176,761 | B1 | 1/2001 | Underhill | |
| 6,318,613 | B1 | 11/2001 | Underhill | |
| 6,332,862 | B1 | 12/2001 | Zandman | |
| 6,517,410 | B1 | 2/2003 | Underhill | |
| 6,606,767 | B2 | 8/2003 | Wong | |
| 6,622,349 | B2 | 9/2003 | Wong | |
| 7,081,034 | B1 | 7/2006 | Zoellner | |
| D529,259 | S | 10/2006 | Faagau | |

(Continued)

OTHER PUBLICATIONS

"The racktrap" http://www.theracktrap.com/.

*Primary Examiner* — Gloria Hale
(74) *Attorney, Agent, or Firm* — Kenyon & Kenyon LLP

(57) ABSTRACT

This discrete, easily accessible, and selectively introduced and selectively removed pocket holds, e.g., keys, cash, credit cards, metro cards, cosmetics, valuables, or other accessories. The pocket is worn in the interior of a brassiere cup or bathing suit top to provide convenience and safety and is shaped and contoured appropriately to the interior of such garment. The pocket can be used with any brassiere and is held in place with a plurality of attaching members, including but not limited to magnets. The pocket is alternately and easily removed from an article of clothing, even in public, and worn as a sachet around the wrist.

18 Claims, 7 Drawing Sheets

U.S. PATENT DOCUMENTS

| | | | |
|---|---|---|---|
| 7,234,996 | B1 | 6/2007 | Donker |
| D554,326 | S | 11/2007 | Nuse |
| 7,364,491 | B2 | 4/2008 | Updyke |
| 2003/0019084 | A1 | 1/2003 | Wong |
| 2003/0236053 | A1 | 12/2003 | Martz |
| 2007/0161329 | A1 | 7/2007 | Torrey |
| 2007/0298684 | A1 | 12/2007 | Spagna |
| 2008/0032600 | A1 | 2/2008 | Updyke |
| 2008/0248718 | A1 | 10/2008 | Henke et al. |
| 2009/0047866 | A1 | 2/2009 | Smith et al. |

* cited by examiner

CONCEALED AND DISCREET SECURITY POCKET

BACKGROUND

This invention relates to a discrete, easily accessible, and selectively introduced and selectively removed pocket which holds, e.g., keys, cash, credit cards, metro cards, cosmetics, valuables, or other accessories and which is contoured to be worn in the interior of a brassiere cup or bathing suit top to provide convenience and safety. The pocket is alternately and easily removed from an article of clothing and worn as a sachet around the wrist.

PRIOR ART

Because many items of women's clothing do not feature pockets, women have long stored items such as cash and cosmetics in the interior of their brassieres instead of carrying a pocketbook. However, this method of storing items does not provide any security as such items are not fully enclosed or secured. Therefore, several security pouches have been created for use during, inter alia, travel. Many of these security pouches are marketed as a method to prevent pick-pocketing or purse-snatching.

For example, pouches permanently attached to a belt worn around the waist are to be worn underneath one's slacks or skirt. These pouches are often rectangular and not contoured to a female's lower torso, causing awkward and obvious protrusions under the clothing. Further, items are not discretely removable from the pouch during use as the pockets are difficult to open and have openings below the beltline.

Another example is a pouch attached to a brassiere's straps. The pouch is worn underneath one's shirt or blouse and lies underneath one's arm. Again, the wearer cannot discretely remove items from the pouch during use because the pouch lies beneath the wearer's arm and the wearer cannot physically reach the pouch or see the contents therein. Further, the pouch can only be worn if the brassiere has conventional straps and could not be used on a strapless, halter, racerback, or cross-the-body-strap brassiere.

Another similar example is a pouch attached to one brassiere strap. The pouch is a flat pouch worn inside the bra. However, the pouch has one attachment point, allowing the pouch to shift inconveniently such that the items are inaccessible without fully removing the pouch from the brassiere. Further, because the pouch requires attachment by a loop around a brassiere strap, the pouch can only be worn is the brassiere has conventional straps and could not be used on a strapless brassiere.

Several other pouches are permanently attached to or part of the brassiere, for example, U.S. Pat. No. 6,517,410 or U.S. Pat. No. 5,496,205. These pouches are neither selectively introduced nor selectively removed from the garment. Thus, these pouches cannot be transferred from one undergarment to another and may only be used with the attached garment.

Other pouches are selectively introduced or selectively removed but do not provide appropriate security to the garment. Further, these pouches are not contoured to the upper torso or chest. Moreover, one cannot access the contents of the pouch easily or discreetly while the pouch is worn. For example, D241,189 does not attach to the garment securely and does not provide any fit or contour to a woman's chest. Meanwhile, U.S. Pat. No. 5,573,331 is attached by a strap with a rectangular pouch sitting between a woman's breasts. This placement is awkward and uncomfortable, causing an unsightly protrusion under one's clothing, unless this surface between the woman's breasts is flat. Further, this pouch is attachable only to brassieres in which a strap connects the two cups, limiting the type of brassiere to which the pouch can be attached. Moreover, because the placement of the pocket falls at the base of the sternum, the wearer cannot discretely access the contents of the pouch unless the outer garment is extremely low-cut such that the outer garment allows one to introduce one's fingers to the pouch interior easily and discretely.

SUMMARY OF THE INVENTION

The present invention is a pocket contoured to the interior cup of a woman's brassiere or bathing suit top. The pocket is securely and selectively attached to the interior of virtually any brassiere or bathing suit top. The pocket is also selectively removable from this location. Further, the pocket secures objects in a convenient and enclosed location from which such objects are easily and discretely removed. The pocket can also be removed and worn as a sachet around the wrist.

The pocket is sized to fit various brassiere cups to enhance comfort and fit. The pocket allows the wearer to carry necessities in an invisible and not easily accessible location to potential muggers. The pocket also allows the wearer to carry valuables and accessories without carrying a pocketbook. The present invention provides the wearer a fashionable alternative to a bulky pocketbook, which attracts muggers and thieves, and is also convenient in, for example, crowded public places such as bars and nightclubs, or open spaces such as at the beach or park where mobility is desirable.

OBJECTS AND ADVANTAGES

It is an object of this invention to provide a closable security pocket for holding keys, cash, credit cards, metro cards, cosmetics, valuables, or other accessories;

It is a further object of this invention that the pocket is worn in a position that is easily accessible to the wearer;

It is a further object of this invention that the pocket's contents are easily and discretely removable by the wearer;

It is a further object of this invention that the pocket is securely attachable to the interior of a brassiere or bathing suit top;

It is a further object of this invention that the pocket is selectively introduced or removed from virtually any brassiere or bathing suit top;

It is a further object of this invention that the pocket is contoured to a woman's chest or interior of a brassiere cup or bathing suit top;

It is a further object of this invention that the pocket does not create unsightly protrusions from underneath the clothing;

It is a further object of this invention that the pocket is made from a thin material that can be invisible from the exterior of the outer garments;

It is a further object of this invention that provides the wearer an option to carry valuables and other accessories, which provides enhanced security and safety for the wearer;

It is a further object of this invention that provides a fashion-conscious option to carry necessities securely without having to carry a pocketbook.

DESCRIPTION OF THE PREFERRED EMBODIMENTS

This invention is further described by reference to the drawings.

Figure 1:
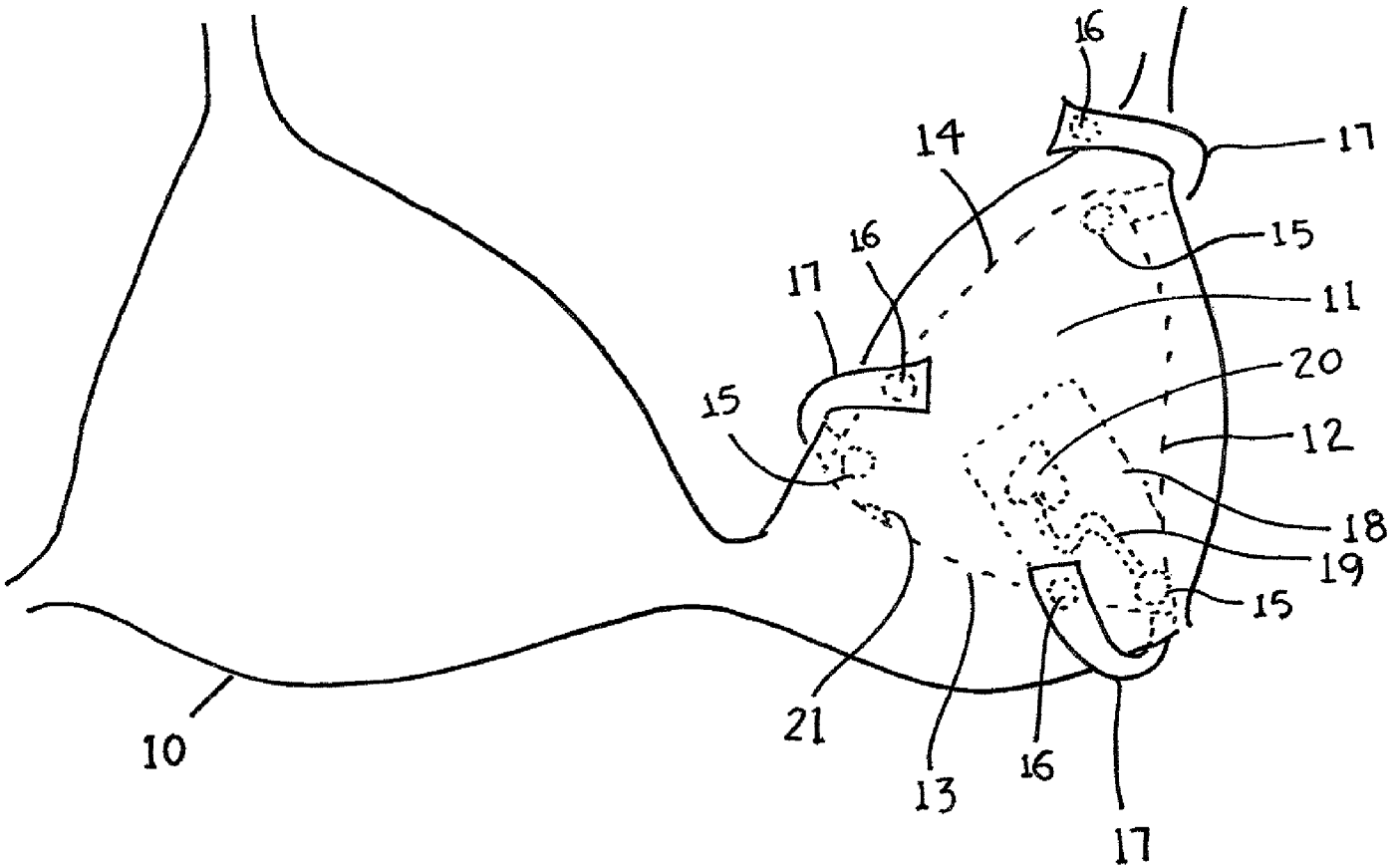
FIG. 1 shows a frontal view of a security pocket with three edges, where the second and third edges are arcuate, and the pocket is contoured to the interior cup of a brassiere.
Figure 2:
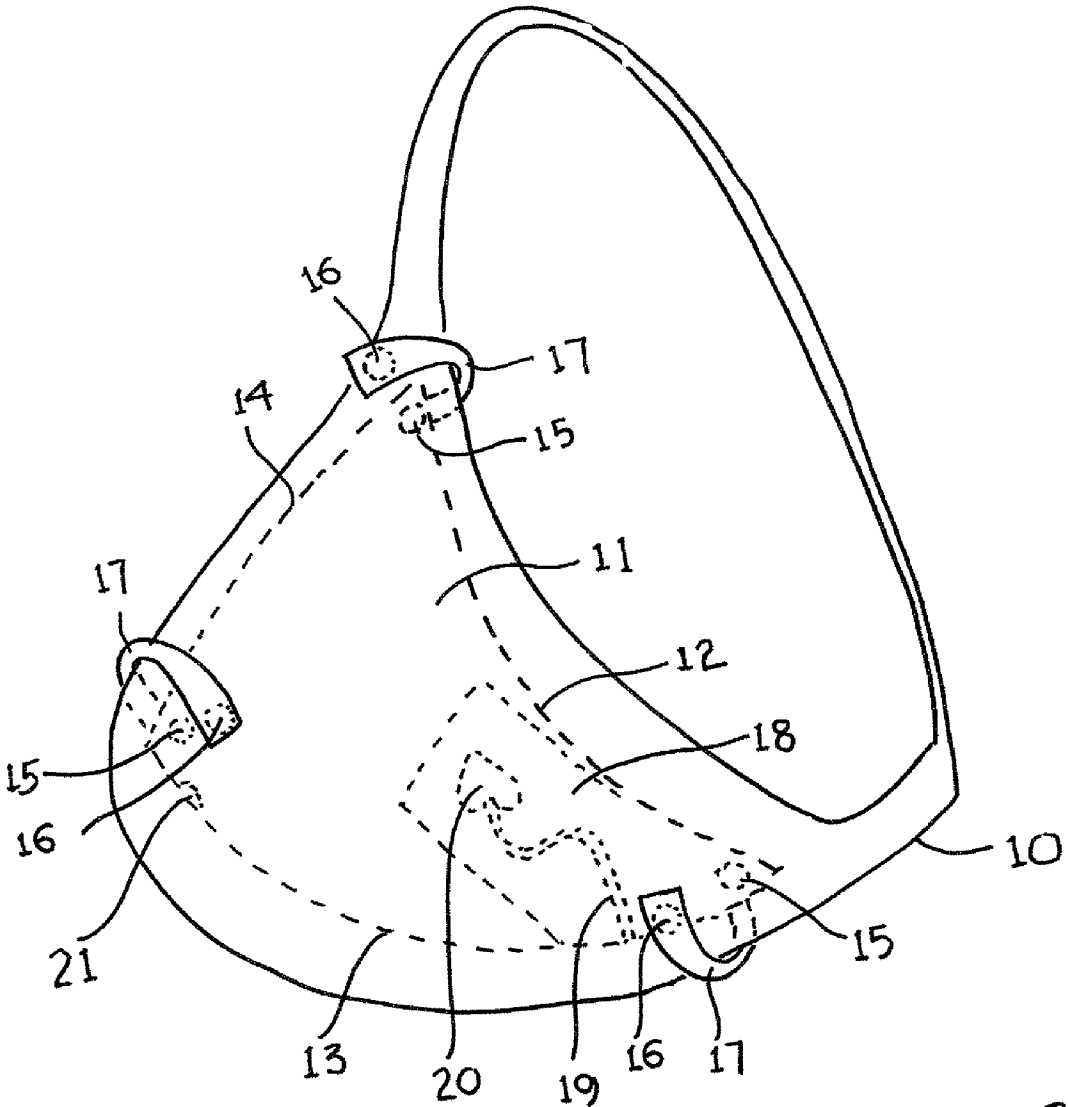
FIG. 2. shows a side view of a security pocket with three edges, where the second and third edges are arcuate, and the pocket is contoured to the interior cup of a brassiere.
Figure 3:
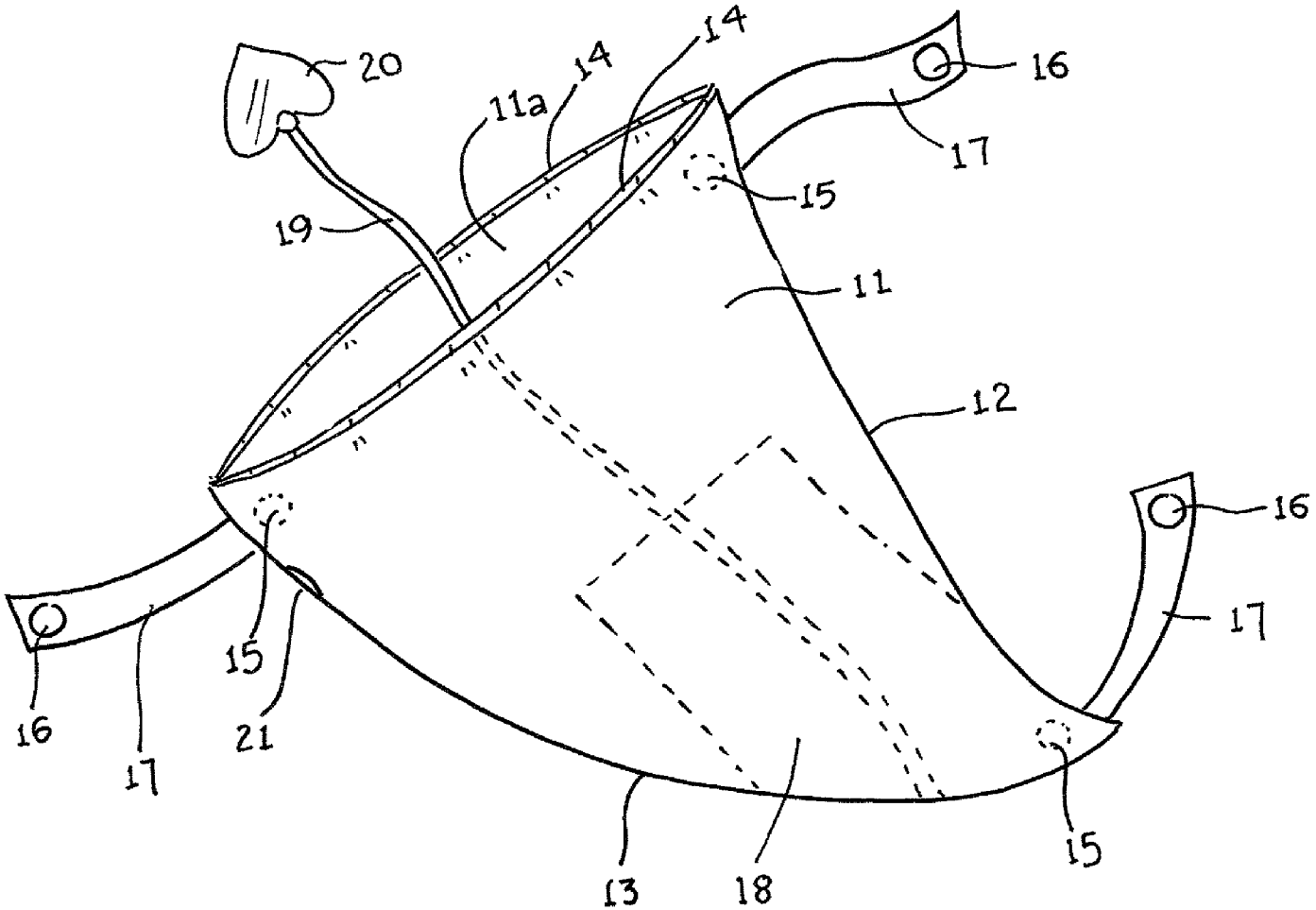
FIG. 3 shows a perspective view of a security pocket with three edges, where the second and third edges are arcuate, and the pocket is contoured to the interior cup of a brassiere, partially opened.

FIGS. 1-3 show a security pocket with a front wall 11 and back wall 11*a* (shown in FIG. 3), with first edges 14, second edges 12, and third edges 13. The first edge of the front wall and the first edge of the back wall define an access opening, and the second edges 12 and third edges 13, which are arcuate, are permanently attached. Walls 11 and 11*a* are contoured to the interior cup of a brassiere 10. Walls 11 and 11*a* can be made of any thin material, including without limitation, lycra, nylon, spandex, silk, lace, polyester, cotton or terrycloth, depending on use and function.

FIGS. 1-3 show the plurality of fasteners 15 and 16, for fastening the security pocket to the interior of brassiere 10. Here, the fasteners are fastener sets, consisting of a first fastener and a second fastener, preferably a thin magnet and its mating magnetic piece, but also any lightweight and waterproof fastener including without limitation double-sided tape (one side of which defines the first fastener and the other side of which defines the second fastener), a magnetic strip and mating magnetic piece, button and eye or loop, hook-and-eye closure, hooks and eyes or loops, and snap buttons and their mating pairs. In this preferred embodiment, fastener sets are magnets 15 and 16. The first fastener magnet 15 is affixed to the pocket. In this preferred embodiment, an attaching member 17, with a first end and a second end, is affixed at its first end to the pocket, and the second fastener magnet 16 is affixed to the second end of the attaching member 17. The first fastener magnet 15 attaches to the second fastener magnet 16 through the fabric of brassiere 10 and the front wall 11 of the pocket.

As depicted in FIG. 3, open edges 14 are elasticized for added security for items introduced and contained within the pocket without the need for additional bulky and inconvenient closures or fasteners. This preferred embodiment also includes an additional pocket 18, here, permanently attached to front wall 11. An attaching member 19, having a first end and a second end, has its first end affixed to third edge 13 and its second end affixed to a small mirror 20.

Figure 4:
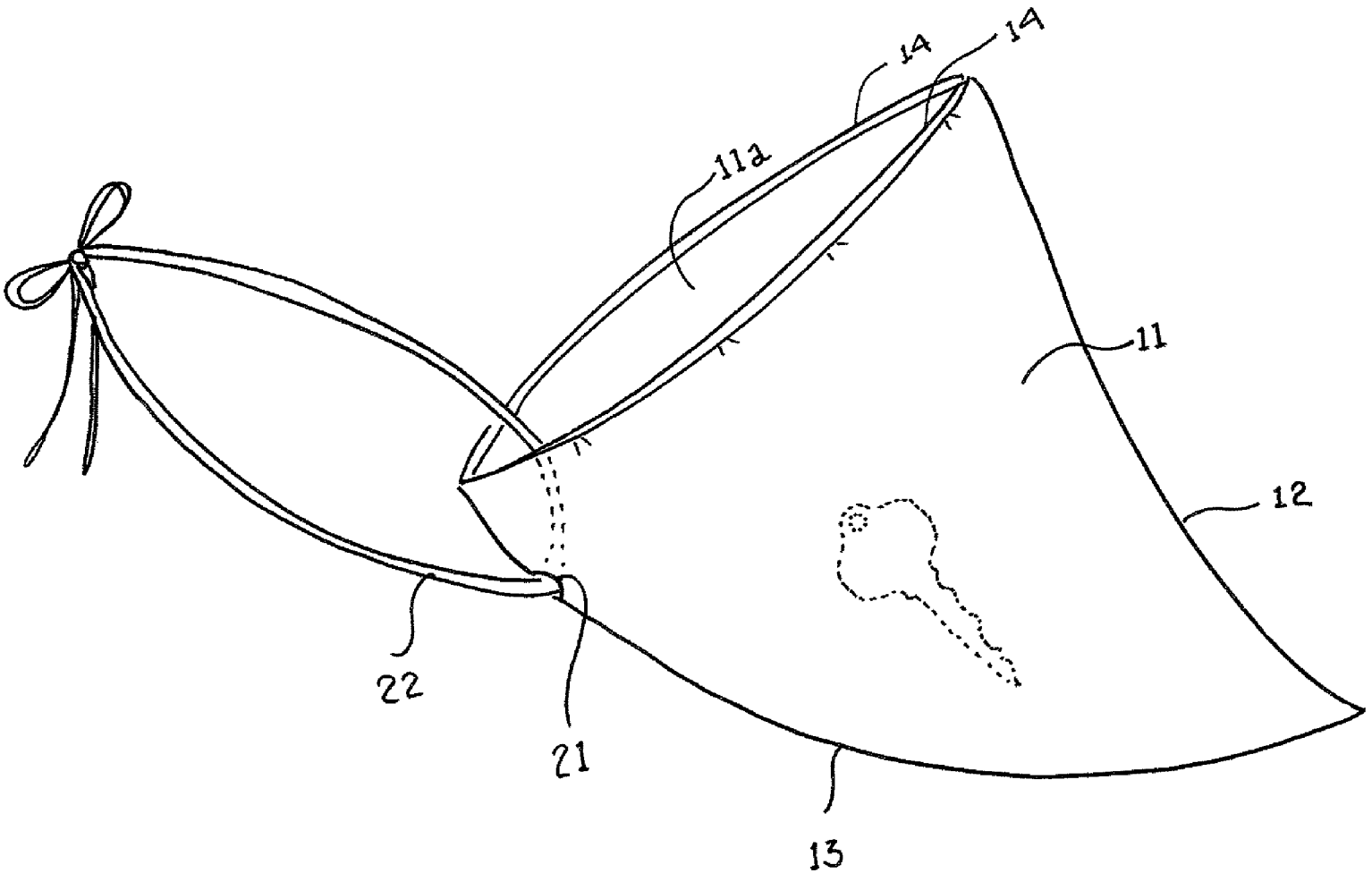
FIG. 4 shows the perspective view of a security pocket with three edges, where the second and third edges are arcuate, with a ribbon threaded through an opening in the pocket to be carried as a sachet around the wrist.

FIG. 4 shows a security pocket that is selectively removed from brassiere 10 and used as a sachet. In this preferred embodiment, carrying strap 22 is introduced to a gap between the third edges 13 of front wall 11 and back wall 11*a* that define opening 21. Carrying strap 22 can be attached to the security pocket in a plurality of methods, including without limitation loops and eyeholes. Carrying strap 22 can, for example, encircle the wrist. A key is shown inside the security pocket.

Figure 5:
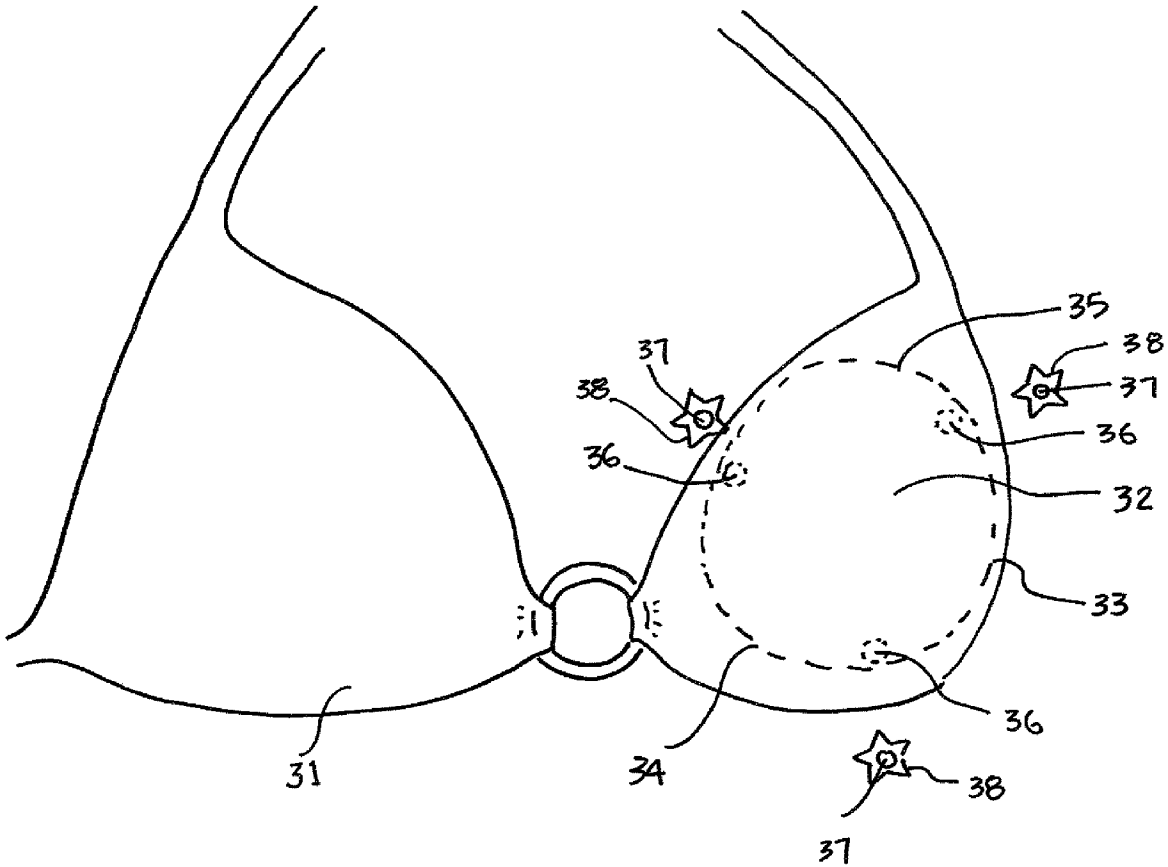
FIG. 5 shows a frontal view of a security pocket with three edges defining a circle, contoured to the interior cup of a brassiere.
Figure 6:
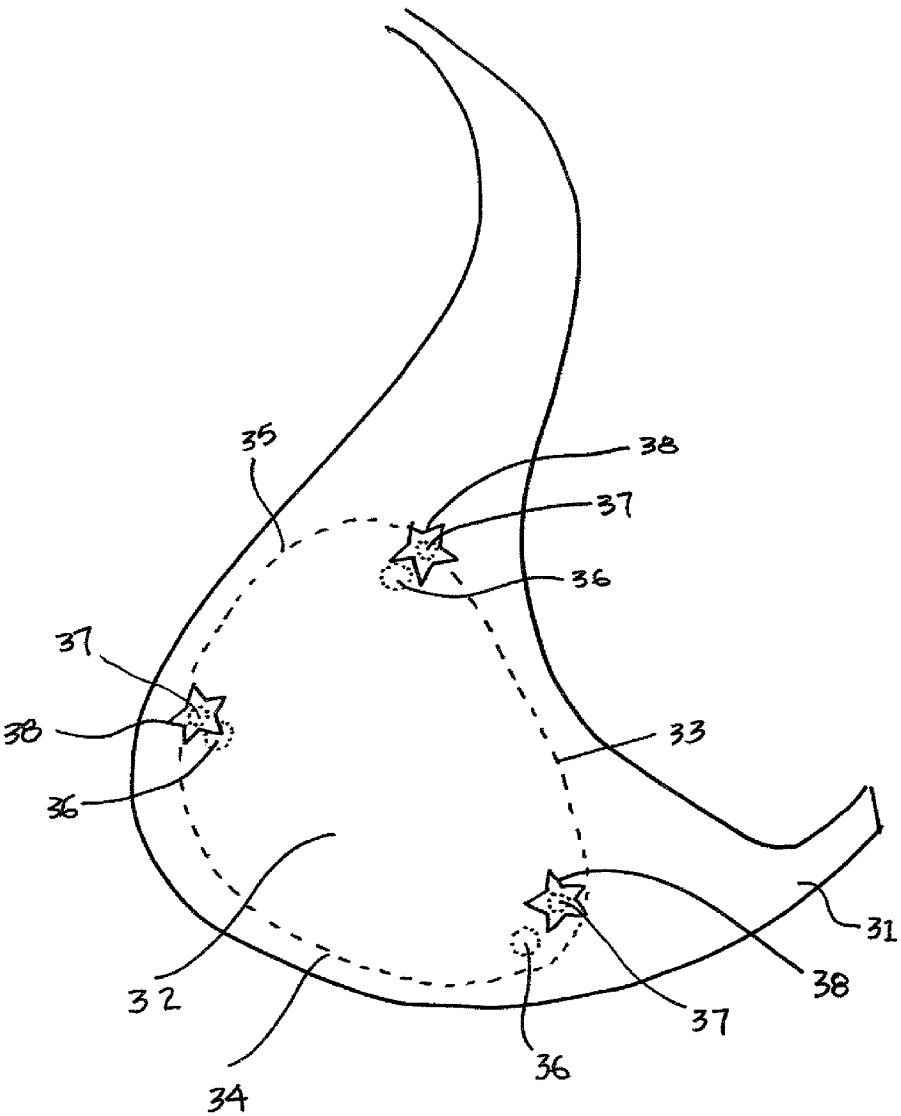
FIG. 6 shows a side view of a security pocket with three edges defining a circle and contoured to the interior cup of a brassiere.
Figure 7:
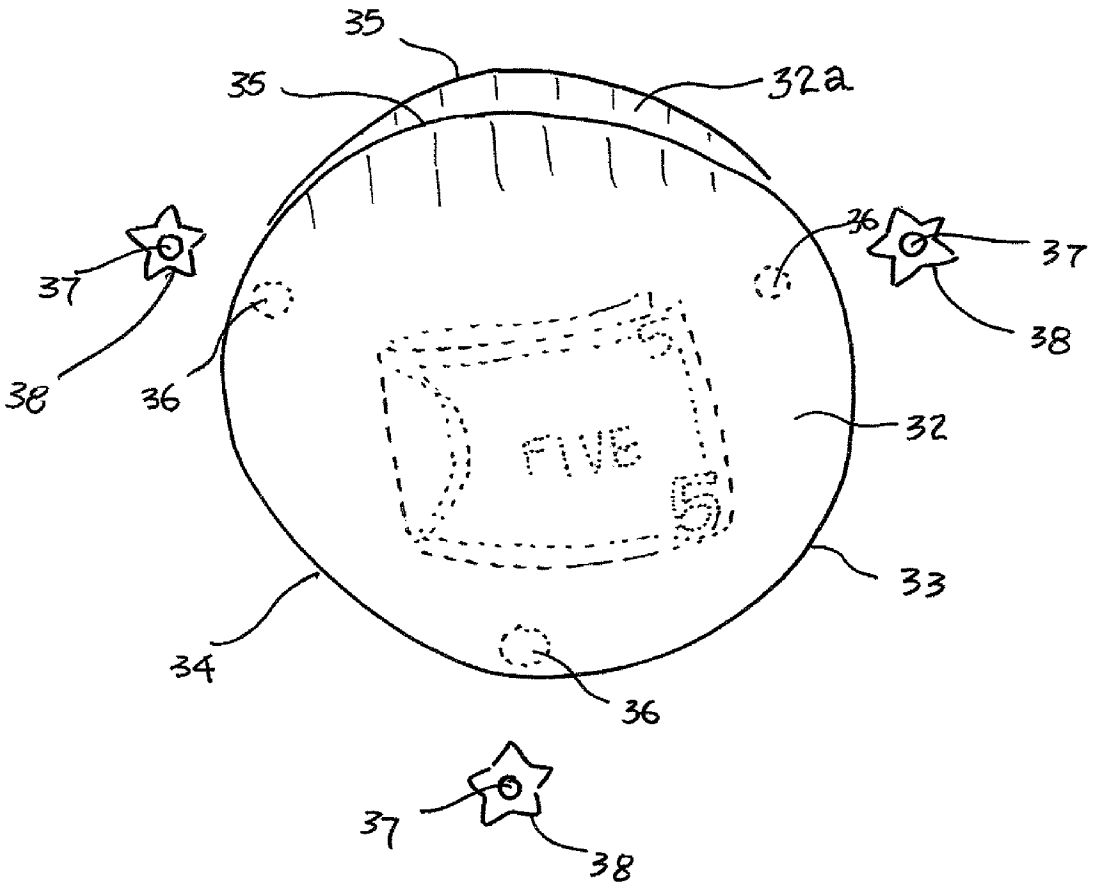
FIG. 7 shows a perspective view of a security pocket with circular edges, contoured to the interior cup of a brassiere, partially opened.

FIGS. 5-7 show a security pocket with a front wall 32 and back wall 32*a* (shown in FIG. 7), with first edges 35, second edges 33, and third edges 34. The first edge of the front wall and the first edge of the back wall define an access opening, and the second edges 33 and third edges 34, which together define a circle, are permanently attached. Other shapes include but are not limited to ovals and rectangles. Walls 32 and 32*a* are contoured to the interior cup of a brassiere 31. Walls 32 and 32*a* can be made of any thin material, including without limitation, lycra, nylon, spandex, silk, lace, polyester, cotton or terrycloth, depending on use and function.

FIGS. 5-7 show the plurality of fasteners 36 and 37, for fastening the security pocket to the interior of the brassiere 31. Here, the fasteners are fastener sets, consisting of a first fastener and a second fastener, preferably a thin magnet and its mating magnetic piece, but also any lightweight and waterproof fastener including without limitation double-sided tape (one side of which defines the first fastener and the other side of which defines the second fastener), a magnetic strip and mating magnetic piece, button and eye or loop, hook-and-eye closure, hooks and eyes or loops, and snap buttons and their mating pairs. In this preferred embodiment, fastener sets are magnets 36 and 37. The first fastener magnet 36 is affixed to the pocket. The second fastener magnet 37 attaches to its mate, first fastener magnet 36, through the fabric of brassiere 31 and the front wall 32.

As depicted in FIG. 7, open edges 35 are elasticized for added security for items introduced and contained within the pocket without the need for additional bulky and inconvenient closures or fasteners. This preferred embodiment also includes ornamental pieces 38, affixed to the second fastener magnet 37, to be worn on the outside of, for example, a bathing suit. Cash is shown inside the security pocket.

While this invention has been described in its preferred embodiments, it is to be appreciated that variations therefrom may be made without departing from the true scope and spirit of the invention.

What is claimed is:

1. In combination, a brassiere and detachable pocket comprising:

a brassiere having a pair of cups, a pocket having a front and back wall, each wall having at least, a first edge, a second edge, and a third edge, the first edge of the front wall aligned with the first edge of the back wall, the second edge of the front wall aligned with and secured to the second edge of the back wall, and the third edge of the front wall aligned with and secured to the third edge of the back wall, wherein the first edge of the front wall and the first edge of the back wall define an access opening to an interior of the pocket, one or more fasteners for fastening the pocket to an interior of a brassiere cup, wherein the one or more fasteners are fastener sets, each set including at least a first fastener and a second fastener, the second fastener cooperating with the first fastener to secure the pocket to the interior of a brassiere cup, and a plurality of attaching members, each with a first end and a second end, wherein the first end of the attaching member is affixed to the pocket, the second fastener is affixed to the second end of the attaching member, and the first fastener is affixed to the pocket.

2. The combination of claim 1, wherein the fastener sets are magnets.

3. The combination of claim 1, wherein there are three fastener sets.

4. The combination of claim 1, wherein the first edges are elasticized so as to bias the first edge of the front wall against the first edge of the second wall to secure any contents introduced into the pocket.

5. The combination of claim 1, wherein the second and third edges are arcuate.

6. The combination of claim 1, wherein the fasteners are selected from the group consisting of: double-sided tape, hook-and-eye closures, hooks, snaps, and buttons.

7. The combination of claim 1, further comprising an additional pocket attached to at least one of the front and back walls.

8. In combination, a brassiere and detachable pocket comprising:

a brassiere having a pair of cups, a pocket having a front and back wall, each wall having at least, a first edge, a second edge, and a third edge, the first edge of the front wall aligned with the first edge of the back wall, the second edge of the front wall aligned with and secured to the second edge of the back wall, and the third edge of the front wall aligned with and secured to the third edge of the back wall, wherein the first edge of the front wall and the first edge of the back wall define an access opening to an interior of the pocket, one or more fasteners for fastening the pocket to an interior of a brassiere cup, an attaching member having a first end and a second end, and a mirror, wherein the first end of the attaching member is affixed to the front or back wall of the pocket and the second end of the attaching member is affixed to the mirror, wherein the mirror is stored in the interior of the pocket and is selectively removable.

9. A pocket with a carrying strap comprising:

pocket having a front and back wall with, at least, a first edge, a second edge, and a third edge, the first edge of the front wall aligned with the first edge of the back wall, the second edge of the front wall aligned with and secured to the second edge of the back wall, and the third edge of the front wall aligned with and secured to the third edge of the back wall, wherein the first edge of the front wall and the first edge of the back wall define an access opening to an interior of the pocket, and one or more fasteners for fastening the pocket to an interior of a brassiere cup, wherein the carrying strap is selectively removable.

10. The combination of claim 9, wherein the one or more fasteners are fastener sets, each set comprising of a first fastener and a second fastener, which when cooperating with the first fastener secures the pocket to the interior of the brassiere cup.

11. The combination of claim 10, wherein the fastener sets are magnets.

12. The combination of claim 10, wherein there are three fastener sets.

13. The combination of claim 10, further comprising a plurality of attaching members, each with a first end and a second end, wherein the first end of the attaching member is affixed to the pocket, the second fastener is affixed to second end of the attaching member, and the first fastener is affixed to the pocket.

14. The combination of claim 9, wherein the first edges are elasticized so as to bias the first edge of the front wall against the first edge of the second wall to secure any contents introduced into the pocket.

15. The combination of claim 9, wherein the second and third edges are arcuate.

16. The combination of claim 9, wherein the fasteners are selected from the group consisting of: magnets, double-sided tape, hook-and-eye closures, hooks, snaps, and buttons.

17. The combination of claim 9, further comprising an additional pocket attached to the front or back walls.

18. The combination of claim 9, further comprising an attaching member having a first end and a second end, and further comprising a mirror, wherein the first end of the attaching member is affixed to the front or back wall of the pocket and the second end of the attaching member is affixed to the mirror, wherein the mirror is stored in the interior of the pocket and is selectively removable.

* * * * *

UNITED STATES PATENT AND TRADEMARK OFFICE

CERTIFICATE OF CORRECTION

PATENT NO. : 8,257,140 B2
APPLICATION NO. : 12/560638
DATED : September 4, 2012
INVENTOR(S) : Judith A. Kenny It is certified that error appears in the above-identified patent and that said Letters Patent is hereby corrected as shown below:

In the claims

At column 4, claim number 1, line numbers 45-68, please replace claim number 1 with the following:

1. In combination, a brassiere and detachable pocket comprising:

a brassiere having a pair of cups;

a pocket having a front and back wall, each wall having at least a first edge, a second edge, and a third edge, the first edge of the front wall being aligned with the first edge of the back wall, the second edge of the front wall being aligned with and secured to the second edge of the back wall, and the third edge of the front wall being aligned with and secured to the third edge of the back wall, wherein the first edge of the front wall and the first edge of the back wall define an access opening to an interior of the pocket;

one or more fasteners for fastening the pocket to an interior of one of the brassiere cups, wherein the one or more fasteners are fastener sets, each set including at least a first fastener and a second fastener, the second fastener cooperating with the first fastener to secure the pocket to the interior of the one of the brassiere cups; and a plurality of attaching members, each with a first end and a second end, wherein the first end of the attaching member is affixed to the pocket, the second fastener is affixed to the second end of the attaching member, and the first fastener is affixed to the pocket.

Signed and Sealed this
Seventh Day of June, 2016

Michelle K. Lee

Michelle K. Lee
*Director of the United States Patent and Trademark Office*

In the claims

At column 5, claim number 8, line numbers 17-38, please replace claim number 8 with the following:

8. In combination, a brassiere and detachable pocket comprising:

a brassiere having a pair of cups;

a pocket having a front and back wall, each wall having at least a first edge, a second edge, and a third edge, the first edge of the front wall being aligned with the first edge of the back wall, the second edge of the front wall being aligned with and secured to the second edge of the back wall, and the third edge of the front wall aligned with and secured to the third edge of the back wall, wherein the first edge of the front wall and the first edge of the back wall define an access opening to an interior of the pocket;

one or more fasteners for fastening the pocket to an interior of one of the brassiere cups;

an attaching member having a first end and a second end; and a mirror, wherein the first end of the attaching member is affixed to the front or back wall of the pocket and the second end of the attaching member is affixed to the mirror, and wherein the mirror is stored in the interior of the pocket and is selectively removable.

At columns 5-6, claim number 9, lines 39-43 and lines 1-7, please replace claim number 9 with the following:

9. A pocket with a carrying strap comprising:

a pocket having a front wall and a back wall, each with, at least, a first edge, a second edge, and a third edge, the first edge of the front wall being aligned with the first edge of the back wall, the second edge of the front wall being aligned with and secured to the second edge of the back wall, and the third edge of the front wall being aligned with and secured to the third edge of the back wall, wherein the first edge of the front wall and the first edge of the back wall define an access opening to an interior of the pocket; and one or more fasteners for fastening the pocket to an interior of a brassiere cup, wherein the carrying strap is selectively removable.

In the claims

At column 6, claim number 10, line numbers 9-13, please replace claim number 10 with the following:

10. The pocket of claim 9, wherein the one or more fasteners are fastener sets, each set comprising a first fastener and a second fastener, which, when cooperating with the first fastener, secures the pocket to the interior of the brassiere cup.

At column 6, claim number 11, line numbers 14-15, please replace claim number 11 with the following:

11. The pocket of claim 10, wherein the fastener sets are magnets.

At column 6, claim number 12, line numbers 16-17, please replace claim number 12 with the following:

12. The pocket of claim 10, wherein there are three fastener sets.

At column 6, claim number 13, line numbers 18-23, please replace claim number 13 with the following:

13. The pocket of claim 10, further comprising a plurality of attaching members, each with a first end and a second end, wherein the first end of the attaching member is affixed to the pocket, the second fastener is affixed to second end of the attaching member, and the first fastener is affixed to the pocket.

At column 6, claim number 14, line numbers 24-27, please replace claim number 14 with the following:

14. The pocket of claim 9, wherein the first edges are elasticized so as to bias the first edge of the front wall against the first edge of the second wall to secure any contents introduced into the pocket.

In the claims

At column 6, claim number 15, line numbers 28-29, please replace claim number 15 with the following:

15. The pocket of claim 9, wherein the second and third edges are arcuate.

At column 6, claim number 16, line numbers 30-32, please replace claim number 16 with the following:

16. The pocket of claim 9, wherein the fasteners are selected from the group consisting of: magnets, double-sided tape, hook-and-eye closures, hooks, snaps, and buttons.

At column 6, claim number 17, line numbers 33-34, please replace claim number 17 with the following:

17. The pocket of claim 9, further comprising an additional pocket attached to the front or back walls.

At column 6, claim number 18, lines 35-41 please replace claim number 18 with the following:

18. The pocket of claim 9, further comprising:

an attaching member having a first end and a second end; and a mirror, wherein the first end of the attaching member is affixed to the front or back wall of the pocket and the second end of the attaching member is affixed to the mirror, wherein the mirror is stored in the interior of the pocket and is selectively removable.